United States Patent [19]

Koenig et al.

[11] 4,200,903

[45] Apr. 29, 1980

[54] COMPACT PORTABLE INDIRECT LIGHTING FIXTURE WITH ACOUSTICAL CONTROL

[75] Inventors: Thomas A. Koenig, Stillwater; Roger Benasutti, St. Paul, both of Minn.

[73] Assignee: Conwed Corporation, St. Paul, Minn.

[21] Appl. No.: 847,535

[22] Filed: Nov. 1, 1977

[51] Int. Cl.[2] ..... A47B 97/00

[52] U.S. Cl. ..... 362/134; 362/86; 362/296; 362/410; 362/806; 362/812; 181/200

[58] Field of Search ..... 362/134, 86, 133, 253, 362/383, 801, 148, 369, 263, 811, 410, 806, 812; 181/200, 205, 198

[56] References Cited

U.S. PATENT DOCUMENTS

| | | | |
|---|---|---|---|
| 2,145,238 | 1/1939 | Falk | 362/133 |
| 3,881,569 | 5/1975 | Evans | 181/200 |
| 4,133,124 | 1/1979 | Chang et al. | 362/811 |

OTHER PUBLICATIONS

Specified Products Inc., "Portable Light Unit," Catalog No. 1-2-P., Mar. 1, 1976.

*Primary Examiner*—Leland A. Sebastian
*Assistant Examiner*—J. L. Barr
*Attorney, Agent, or Firm*—Eyre, Mann, Lucas & Just

[57] ABSTRACT

A free standing indirect lighting fixture utilizing a one-piece molded reflector and a diagonally mounted high intensity discharge lamp has a frosted diffuser over the lamp. Acoustic material on the fixture absorbs ballast hum as well as adding acoustic absorbtion to the room. A back lighted information strip may optionally be included.

5 Claims, 3 Drawing Figures

COMPACT PORTABLE INDIRECT LIGHTING FIXTURE WITH ACOUSTICAL CONTROL

BACKGROUND OF THE INVENTION

Area lighting in large rooms such as stores and offices is conveniently done with indirect lighting units which project light upward onto a diffusely reflecting ceiling. Due to the high efficiency of high intensity discharge (HID) lamps, this type of lamp is preferred in a large indirect lighting system. An HID lamp consists of a transparent container containing a gas discharge tube. The transparent container is quite large and requires the support of a substantial socket. In addition, a reactive ballast is required to regulate the power to the lamp. One method of providing flexibility in the room layout, consists of mounting a high intensity HID lamp in a portable column which positions the lamp approximately 30 inches or more from the ceiling and in which a multi-faceted reflector with specular surface directs the light upward toward the ceiling through a clear lens. The column may be moved from place to place as required in modifying the layout of the room.

SUMMARY OF THE INVENTION

The present invention teaches an indirect lighting system in which a high intensity discharge lamp is diagonally mounted horizontally in a square column. A unitary reflector below and alongside the lamp is shaped to direct the light from the HID lamp toward the ceiling. Frosted glass or other diffusing means covering the lamp of the reflector diffuses the light for uniform ceiling illumination. Acoustically absorbing material about the exterior of the column muffles the hum of the contained ballast as well as adds acoustic absorber to the room.

A back lighted information panel using light from the HID lamp may be included in the structure for decorative and utilitarian purposes.

DETAILED DESCRIPTION OF THE PREFERRED EMBODIMENT

Figures 1, 2, 3:
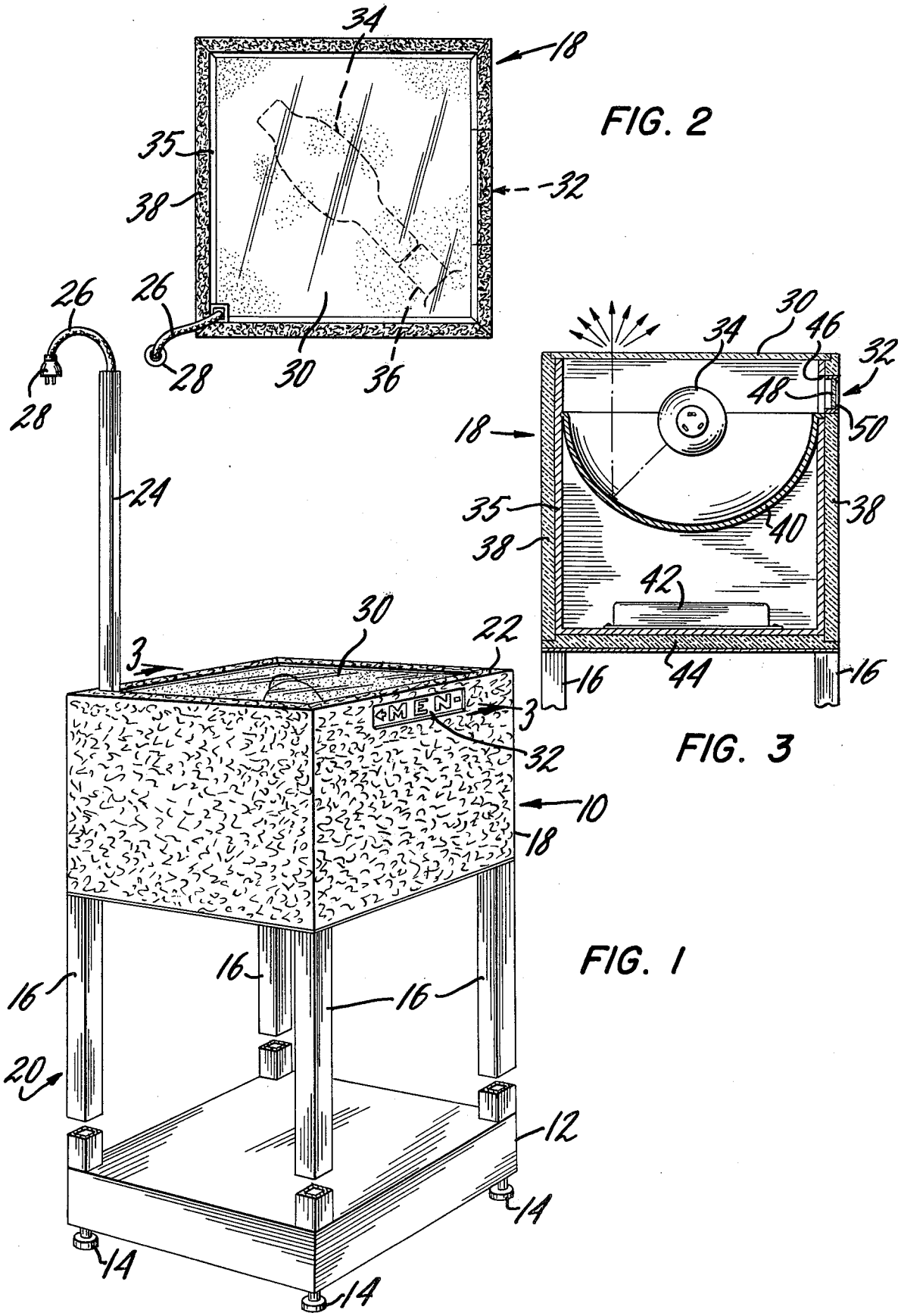
FIG. 1 shows an overall perspective view of an embodiment of the invention.
FIG. 2 shows a plan view of the lighting fixture.
FIG. 3 shows a cross section taken along 3—3 of FIG. 1.

Referring to the overall perspective view in FIG. 1, the portable indirect lighting fixture is shown generally at 10. A base 12 with leveling devices 14 rests upon the floor. Support columns 16 at the four corners of the base extend upward to a lamp enclosure 18. The intermediate region 20 between the base 12 and the lamp enclosure 18 may be open as shown or may be enclosed. Alternatively, it may have shelves or display racks and may have openable doors. The top 22 of the lamp enclosure 18 should be located 30 inches or more from the ceiling in order that uniform ceiling illumination will be attained. A power pole 24 optionally located at one of the corners of the lamp enclosure extends upward toward the ceiling and has an electric cord 26 with attached electric plug 28 protruding from the top. The power pole 24 shown as an extension of one of the support columns 16 at one corner of the lamp enclosure 18 may instead be located along one of the sides of the lamp enclosure. In some installations, the power may be obtained at floor level and the power pole may be eliminated. A diffusing plate 30 preferably of frosted glass covers the top ot the lamp enclosure. An information panel 32 may be included in one or more sides of the lamp enclosure. The information panel 32 may be partially transparent and receive rear illumination from the interior of the lamp enclosure to provide information, directions or decoration.

Referring now to the view shown in FIG. 2, the lamp enclosure 18 contains a high intensity discharge lamp 34 disposed diagonally in the generally square lamp enclosure. A socket 36 supports and provides power to the HID lamp. The lamp enclosure 18 has an inner structure 35 preferably of metal. The inner structure 35 is covered with sound absorbing material 38 which may be porous mineral fiber board or other sound absorbing structures well-known in the art. Due to the heat generated by the HID lamp 34, the sound absorbing material 38 is preferably capable of withstanding elevated temperatures of at least as high as those generated by the HID lamp without burning.

Referring now to FIG. 3, a reflector 40 surrounds the HID lamp 34 and directs the light rays from the HID lamp toward the diffusing plate 30. The reflector 40 is reflecting surface formed by molding or laying up glass, fiber glass, plastic or metal in a concave shape. It is highly desirable for the reflecting surface to be a unitary continuous structure so that hot spots are eliminated. In the case of non-reflecting materials, a reflecting surface is added by well-known means to the concave surface of reflector 40. A ballast 42 may be located within the lamp enclosure 18. The ballast hum is absorbed by the sound absorbing material 38 on the sides of the lamp enclosure 18 and by sound absorbing material 44 located on the bottom of the lamp enclosure 18. The ballast 42 may alternatively be located in the base 12. This is especially desirable in cases where the power input is at or near the floor level. The relocation of the relatively massive ballast 42 to a lower location improves the stability of the structure.

The information panel 32 may be located in an aperture 46 in the side of the lamp enclosure 18. The aperture 46 preferably passes completely through the sound absorbing material 38 and the inner structure 35. A transparent panel 48, which may be of diffusing material such as frosted glass and may optionally be colored, is positioned in the aperture 46. Scattered light inside the lamp enclosure 18 illuminates the inside of the transparent panel 48. An information bearing or decorative blocking structure 50 is located in front of and adjacent to the transparent panel 48. The blocking structure may contain apertures which allow a portion of the rear illuminated transparent panel 48 to be visible. Alternatively, the information panel 48 may be a unitary structure in which varying color and opacity provides the informative or decorative effect.

It will be understood that the claims are intended to cover all changes and modifications of the preferred embodiments of the invention, herein chosen for the purpose of illustration which do not constitute departures from the spirit and scope of the invention.

What is claimed is:

1. A free-standing direct lighting fixture comprising:

(a) a frame;

(b) said frame being adapted to free standing on a generally horizontal surface;

(c) a lamp enclosure on said frame;

(d) an upward-directed reflector in said lamp enclosure;

(e) a high-intensity discharge lamp mounted horizontally in said lamp enclosure above said reflector and disposed diagonally to said frame;

(f) a frosted glass diffusing plate over said lamp and reflector;

(g) a ballast for said lamp within said enclosure; and (h) sound absorbing material on the exterior of said enclosure capable of muffling sound generated internally in said enclosure while simultaneously absorbing sound exterior to said enclosure.

2. A free-standing indirect lighting fixture comprising:

(a) a frame;

(b) a lamp enclosure on said frame;

(c) an upward-directed reflector in said lamp enclosure;

(d) a high-intensity discharge lamp horizontally mounted in said lamp enclosure above said reflector;

(e) a diffusing plate above said lamp and reflector;

(f) a ballast for said lamp within said lamp enclosure; and (g) sound absorbing material on the external surface of said enclosure.

3. The apparatus recited in claim 2 wherein said diffusing plate is frosted glass.

4. The apparatus recited in claim 2 further comprising an integral power pole extending upward past said lamp enclosure.

5. The apparatus recited in claim 2 further comprising:

(a) an aperture through said lamp enclosure and the sound absorbing material thereon;

(b) an at least partly translucent plate covering at least part of said aperture; and (c) said plate containing relatively opague areas forming a decorative or informative pattern.

* * * * *

UNITED STATES PATENT AND TRADEMARK OFFICE

CERTIFICATE OF CORRECTION

PATENT NO. : 4,200,903

DATED : April 29, 1980

INVENTOR(S) : Koenig et al.

It is certified that error appears in the above-identified patent and that said Letters Patent are hereby corrected as shown below:

Column 2, line 64, claim 1, change "direct" to read --indirect--.

Column 4, line 20, claim 5, change "opague" to --opaque--.

Signed and Sealed this

*Second* Day of *September 1980*

[SEAL]

*Attest:*

SIDNEY A. DIAMOND

*Attesting Officer*

*Commissioner of Patents and Trademarks*